United States Patent [19]

Capdeboscq

[11] Patent Number: 4,970,924

[45] Date of Patent: Nov. 20, 1990

[54] CIRCULAR TOOL ARRANGEMENT

[75] Inventor: Bernard Capdeboscq, Saint-Just Chaleyssin, France

[73] Assignee: SA Martin, France

[21] Appl. No.: 326,998

[22] Filed: Mar. 22, 1989

[30] Foreign Application Priority Data

Mar. 22, 1988 [FR] France ..... 88 04052

[51] Int. Cl.[5] ..... B26D 7/26

[52] U.S. Cl. ..... 83/332; 83/665; 83/676; 83/699; 493/370; 493/471

[58] Field of Search ..... 83/508.3, 332, 665, 83/699, 675, 676, 677, 678, 481, 482; 493/365, 367, 368, 471, 475

[56] References Cited

U.S. PATENT DOCUMENTS 3,952,637 4/1976 Lambert et al. ..... 83/332 x
3,985,066 10/1976 Kern ..... 93/58.2
4,502,357 3/1985 Hussissian ..... 83/332
4,781,668 11/1988 Mowry ..... 83/665 x
4,805,502 2/1989 Ishigure ..... 83/332

*Primary Examiner*—Frank T. Yost
*Assistant Examiner*—Rinaldi Rada
*Attorney, Agent, or Firm*—Hill, Van Santen, Steadman & Simpson

[57] ABSTRACT

A circular tool arrangement which includes a circular rim having an inner rim with the circular rim having a plurality of circular seats arranged on a first radius and the inner rim having a plurality of circular seats arranged on a second radius. Tools shaped as either cutting members or creasing members are arranged on the rim and have projections which are engaged in one of the groups of seats and each of the arrangements has a ring provided with concentric grooves for receiving projections on the side of the tool facing the ring. The rings are moved in the clamping engagement by a spring arrangement which can be released by applying axial pressure on the heads of the spring arrangement to shift the ring from a clamping position to an open position to enable removal of the tools.

6 Claims, 3 Drawing Sheets

CIRCULAR TOOL ARRANGEMENT

BACKGROUND OF THE INVENTION

The present invention is concerning a fastening arrangement for a circular tool arrangement which is designed so that the circular arrangement can be shifted laterally around a rotatable shaft carrying at least one of the circular tool arrangements.

Processing machines are known which have circular tool arrangements which support tools having a form of an annular sector and the circular tool arrangement is shiftable with respect to a shaft that carries the tool arrangement. Thus, it is possible to convert a sheet of material, such as a sheet of paper board or a corrugated board, into blanks by passing the sheet through the machine so that the tools of the circular tool arrangement can perform a process on the board; which is cutting if they are cutting tools and creasing if they are creasing tools. Generally, such machines include an upper rotary shaft supporting the circular tool arrangements and a lower rotary shaft carrying the circular counterparts which are situated opposite the circular tool arrangements and have grooves for coacting with the tool portions of the tool arrangement. The cutting and creasing tools will generally be called cutting or creasing members.

Such cutting and creasing members operate jointly with the countermember situated on the circumference of the circular counterparts and which are fitted on the lower rotary shaft. The tools can be designed to make slots, diagonal corner cuts and creases on the paper board or corrugated sheets which runs between the cutting and creasing members and the countermember.

As mentioned above, the members are shiftable angularly on the circumference of the circular tool arrangement and it is possible, for instance with two non-adjacent cutting members, to achieve two cuts with every revolution of the rotary shaft, for example a cut adjacent the front or leading edge and a cut adjacent the rear or trailing edge of the sheet of material being processed.

In order to be able to consider the length of the sheet to be converted, it is useful to arrange on the circumference of the circular tool arrangement at least a first fixed cutting member and a second cutting member which can be adjustable with regard to its angular position. In order to take into account the width of the sheet to be converted, several circular apparatuses provided with cutting and creasing members are to be arranged side-by-side on the same rotary shaft. Thus, a sheet can be processed into a blank which has several panels with several flaps, such as the blank illustrated in U.S. Pat. No. 3,985,066, whose disclosure is incorporated by reference thereto.

On known devices, the shiftable members or adjustable members are secured on an inner rim which has teeth along one periphery. To enable a simultaneous setting of all the shiftable or adjustable members of several of the circular tool arrangements located side-by-side, a shaft extends between each of the tool arrangements and includes a pinion for each arrangement that engages the inner rim in such a way that the inner rims of each arrangement can be simultaneously shifted to present a new angular position for the member mounted thereon.

Conspicuously, the above-mentioned cutting members undergo appreciable wear when converting material. Furthermore, they can be worn or damaged, for instance, by the wrong manipulation or by a sudden jam-up. There is also a risk of the cutting members interfering in that it might prevent the obtaining of a certain slot dimension. In the above-mentioned cases, it will, thus, be necessary to remove one or the other of the cutting members carried by a circular tool arrangement. Such a removable operation should obviously be carried out quickly and easily so that the machine will be down during the shortest time possible in order that the machine's production capacity is not impaired.

The fastening devices of the cutting members, as known up to now, hold the cutting members by means of retaining elements on which the cutting members are fitted by means of screws or expensive and complex couplings which are not very reliable. Such an arrangement is disclosed in the above-mentioned U.S. Patent.

SUMMARY OF THE INVENTION

The purpose of the present invention is to provide a solution that allows a quick fixing and removal of members from a circular tool arrangement by means of a simple, efficient and economical design. Such a device allows especially the quick and easy removal or the securing of a number of cutting members to be carried out by a circular tool arrangement.

To resolve these problems, the invention is directed to an improvement in a circular tool arrangement which is laterally shiftable along a rotary shaft and which arrangement includes means for supporting the tools, means for holding the tools against said means for supporting them and means for shifting said tool holding means.

The improvements are that the means for supporting the tool consists of a circular rim having an engagement surface provided with a plurality of circular seats arranged circumferentially at a constant first radius having its center on the axis of the rotary shaft and having a groove concentric with said shaft forming a seat for receiving an inner rim which is provided with teeth on one of its peripheries and which inner rim can be moved relative to the circular rim. The inner rim has a second plurality of circular seats or holes on an engagement surface, which are arranged on a second constant radius having its center on the axis of the shaft. The tool holding means consist of a circular ring having an engaging surface facing the engaging surfaces of the rims and being provided with two concentric grooves, one on the first radius and the other on the second radius, said ring being provided with at least one rod extending perpendicular to the engagement surface and extending through the circular rim of the tool supporting means, said rod being arranged in such a way as to have a head for entrapping a compression spring between the head and an opposite surface of the circular rim. The means for shifting a tool holding means consists of a laterally shiftable device along the rotary shaft which holds the circular arrangement, said laterally shiftable device acting with one of its sides on the end of the heads of said rod to shift the rod and the ring to move the engagement surface of the ring away from the engagement surface of the circular rim to release any tool engaged therebetween. The device according to the invention has the advantage of holding the tools in position and simultaneously enables an axial shifting of the tool holding means in order to cause a simultaneous opening of every consecutive tool arrangement situated on the rotary shaft to enable the accessibility to the tools to enable their being removed or replaced easily and quickly.

Other advantages and features of the invention will be readily apparent from the following description of the preferred embodiment, the drawings and claims.

DESCRIPTION OF THE PREFERRED EMBODIMENTS

Figure 1:
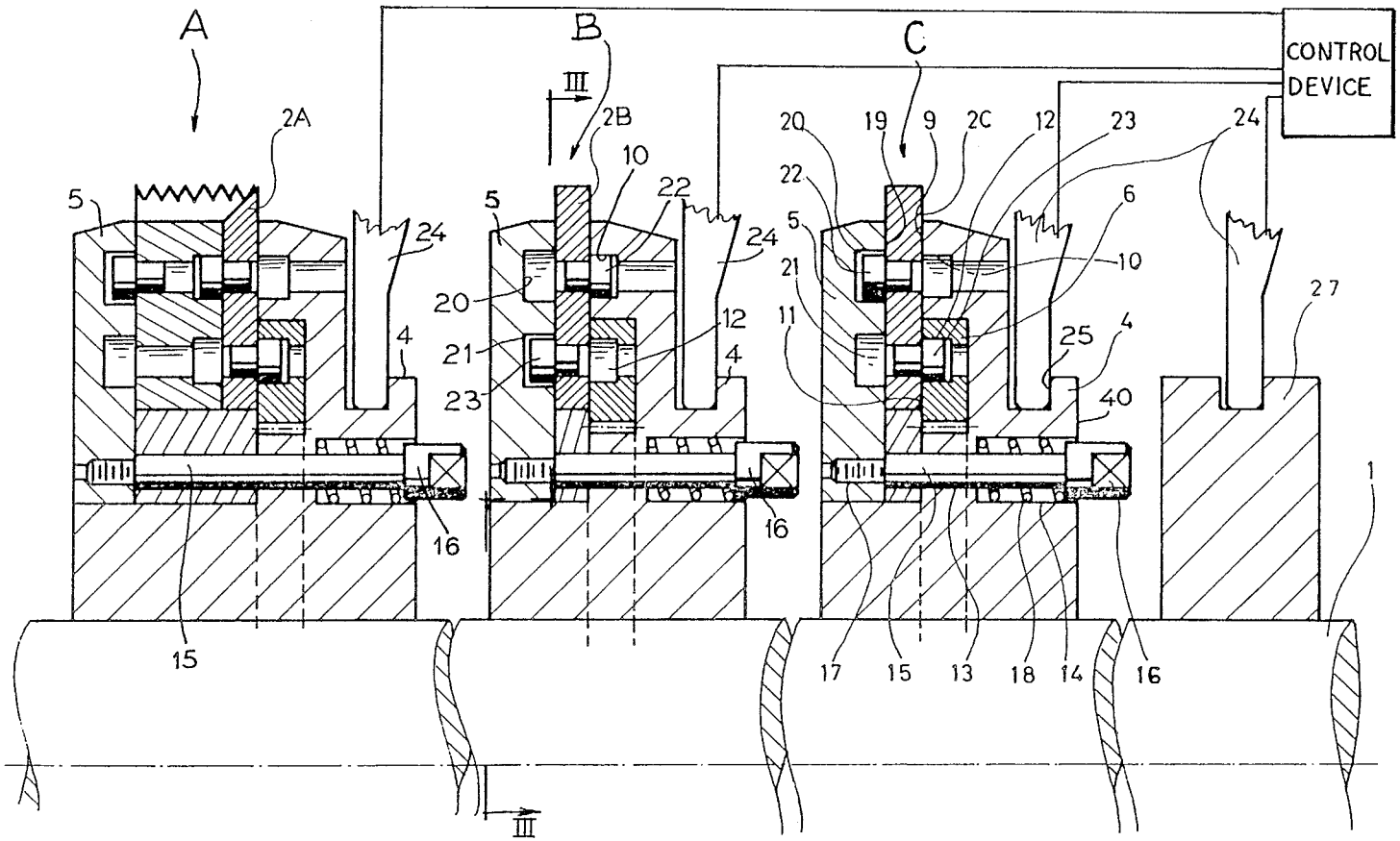
FIG. 1 is an axial cross sectional view with portions in elevation of a plurality of circular tool arrangements mounted on a shaft.
Figure 2:
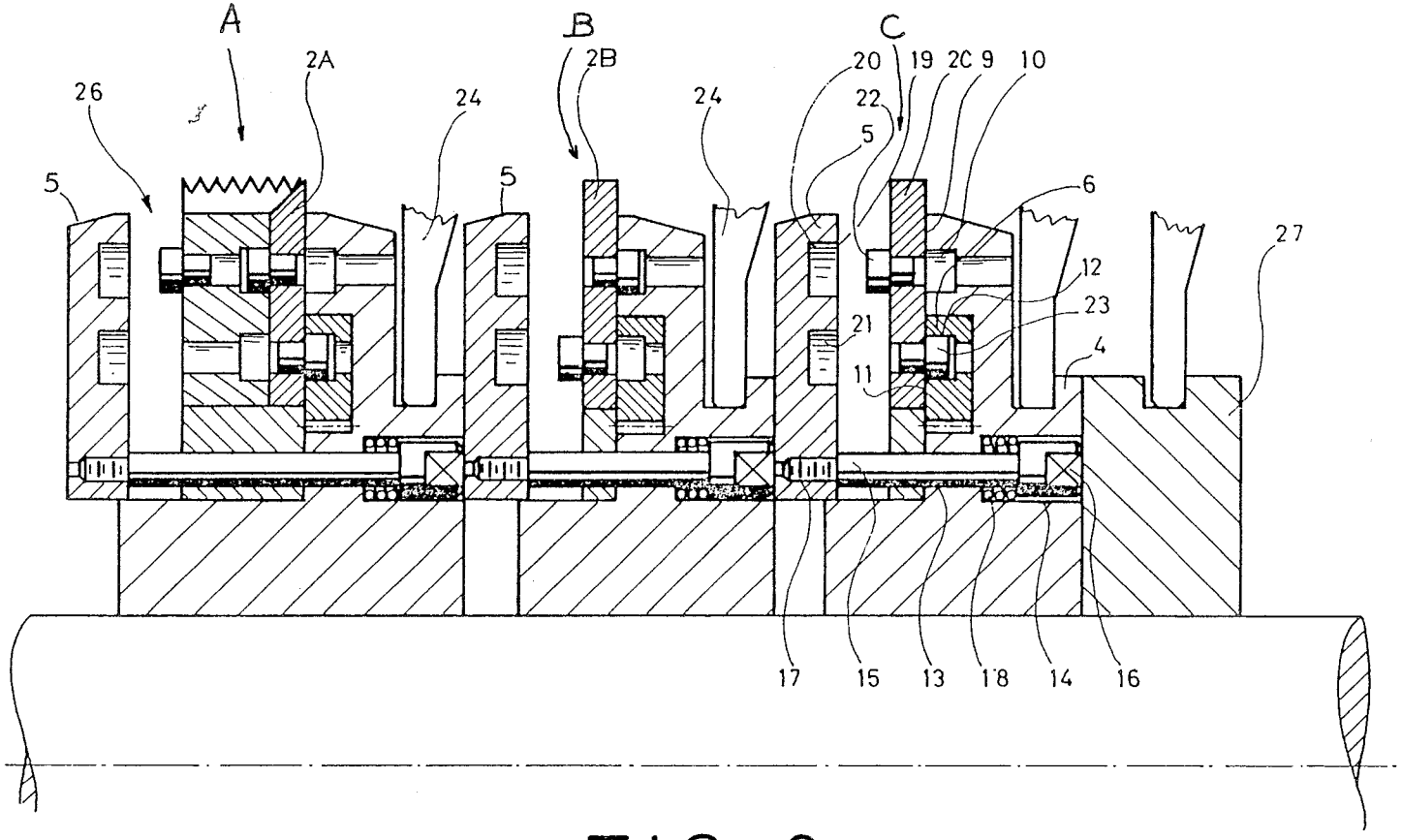
FIG. 2 is a partial axial cross sectional view of the arrangement of FIG. 1, with each of the circular tool arrangements in an opened tool releasing condition.
Figure 3:
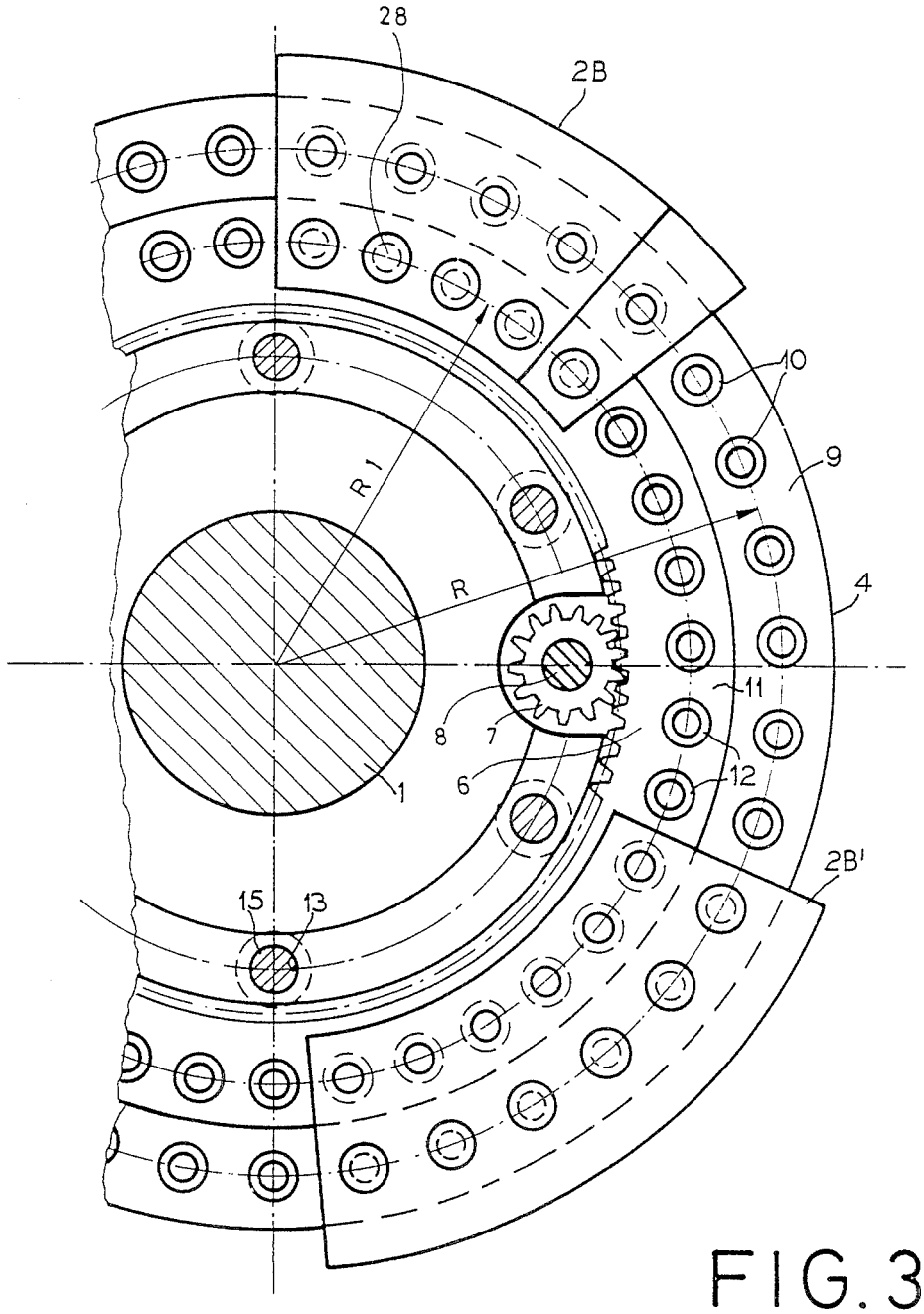
FIG. 3 is a partial transverse cross sectional view taken along the lines III—III of FIG. 1.

The principles of the present invention are particularly useful when incorporated into circular tool arrangements, generally indicated at A, B and C in FIGS. 1 and 2. As illustrated, the circular tool arrangements A, B and C are arranged side-by-side along an axis of a rotary shaft 1. The lateral position of each of these arrangements depends on the particular area of the operation, such as, for instance, cutting and creasing which is to be achieved on a sheet of material to be processed. The circular tool arrangements A, B and C are provided on their circumference with tools, for example cutting members 2A, 2B and 2C. As illustrated in FIG. 3, these cutting members, such as 2B and 2B' are sectors of a circle and can be moved to be positioned at different angular positions relative to each other. It should be understood that the number of circular tool arrangements A, B and C, which are provided on the rotary shaft 1, may vary, as required with an equally variable number of cutting members or tools on the circumference of each of the tool arrangements.

Any one of the circular tool arrangements A, B or C may consist generally of a circular rim 4 which is mounted on the shaft 1 by a key arrangement to rotate therewith. Associated with each of the circular rims 4 is a circular ring 5 and, as illustrated, the cutting tool, such as the tool 2C, is clamped between the rings 5 and 4 for the arrangement C. Each of the circular rims 4 has a groove which is concentric with the axis of the shaft 1 to form a seat for receiving an inner rim 6 which, as illustrated in FIG. 3, has teeth on an inner periphery that are engaged by a pinion 7 mounted on a shaft 8 which extends between each of the circular tool arrangements mounted on the shaft 1. Thus, rotation of the shaft 8 will cause each of the inner rims 6 to move simultaneously in the same direction and for the same amount. The circular rim or first rim 4 on a gripping surface 9 is provided with a plurality of holes 10 which are spaced at regular intervals on a circle of a radius R from the axis of the shaft 1. As also illustrated in FIG. 3, the inner rim 6 on a surface 11 has a plurality of spaced holes or circular seats 12 which are spaced at a regular interval on a circumference of a circle having a second constant radius R1. The first rim 4 also has several through holes 13 which, as illustrated in FIG. 1, have a cylindrical recess or counterbore 14 on a surface 40 which is opposite the engagement surface 9. A rod 15, which has a head serving as a bearing 16, is provided in each of the through holes 13. The rod 15 has a threaded end which is received in a threaded bore 17 in the circular ring 5. Disposed between the base of the counterbore 14 and the head 16 is a compression spring 18 which urges the rod 13 to the right, as illustrated in FIG. 1, to urge the ring 5 into clamping engagement with the tools, such as 2C, disposed between a clamping surface 19 of the ring 5 and the engagement surface 9 of the rim 4.

The ring 5 is provided with two concentric grooves 20 and 21 on the clamping surface 19 with the groove 20 having approximately the radius R and the groove 21 having a center being on an approximate radius R1. Each of the cutting members, such as 2B and 2C, on one surface are provided with projections or nipples 22 and on the other surface provided with nipples or projections 23. The projections 23 are offset from the projections 22 so that when the cutting member 2C is mounted, as illustrated in FIG. 1, the nipples 23 are received in the bores 12 of the rim 6, while the projections 22 are received in the groove 20. If the cutting member 2C were rotated through 180°, then it would be the same as the cutting member 2B, which is mounted with the nipples 22 in the bores or holes 10 and the nipples 23 received in the groove 21. Depending on whether the tool is mounted as the tool 2C or 2B depends on whether or not the tool is a fixed or adjustable tool. The tool 2B is a fixed tool as far as its angular relationship with the rim 4 of the tool arrangement B. The tool 2C is an adjustable tool or movable tool, since it is fixed to the rim 6 and is free to move with the rim 6 relative to the first rim 4. As mentioned before, merely by turning the tool 2C end for end it will assume the position of the tool 2B and, thus, become a fixed tool instead of a movable tool. The tool 2C, as illustrated, will move with rim 6 when the pinion 7 is rotated. In this way, it is possible to modify the angular distance separating the two cutting members, such as the cutting members 2B and 2B' of FIG. 3. The arrangement as described here has the advantage that enables an indifferent use of the fixed member instead of a movable member or vice versa.

Each of the arrangements A, B and C is illustrated in an open position in FIG. 2. In this position, the exchange of the various cutting members, such as 2A, 2B and 2C, is possible. The arrangements A, B and C are shiftable laterally along the rotary shaft 1. The shift can be achieved by means of a fork 24 which engages a groove 25 of each of the circular rims 4. Consequently, if the circular arrangement B is shifted towards the left-hand side of FIG. 2, with the arrangement A being simultaneously held by its respective fork 24 in a fixed position, the circular ring 5 of the arrangement B will engage the heads 16 to, thus, shift the ring 5 of the arrangement A to the opened position to provide an opening or gap 26. With the gap 26, it is easily possible to remove the tool 2A and to replace it if necessary.

In certain cases, for instance when the job has been changed, it will be necessary to change all of the cutting members of the arrangements A, B and C simultaneously. Generally, on the occasion of a complete setting of the lateral position of the circular arrangements, the latter are to be shifted against one or the other end of the rotary shaft 1, whereupon an electronic computer (which is not illustrated) will provide the shifting rate for every circular arrangement to the control device for each of the forks 24. The fact that all the circular arrangements are joined together is used for imparting an additional lateral advance resulting in the opening of all the circular arrangements under the effect of the side of the circular ring exerting on the head or rods 15 of the adjacent arrangement. This procedure, though, is not perfect, as it does not allow the opening of the circular arrangement situated at the end of the rotary shaft, since this arrangement, such as the arrangement C, while acting as a pushing device would not have anything acting on the heads of its rods 15 to cause its second ring 5 to move to the opened position.

In order to insure that all of the arrangements will be reliably opened, it is desired to provide a pressure ring 27 adjacent the last circular arrangement, such as C as illustrated in FIG. 2. The pressure ring 27 is controlled in such a way that with all the circular arrangements arranged and held by their forks 24 in their initial setting or fixed positions, it will cause a shift of the rod 15 of the arrangement C. As the shift normally entails the shift of the circular ring 5 which, in turn, will cause the shift of the rods 15 of the arrangement B, which will result in the movement of the circular ring 5 of the arrangement B which, in turn, causes the engagement with the rods of the arrangement A to open the ring 5 of the arrangement A. Thus, as the ring 27 is moved, all of the arrangements, A, B and C, will be opened simultaneously to allow the removal of the cutting members or tools and to replace them with new members. As a rule, the nipples 22 and 23 are sufficient for holding each of the members 2A, 2B and 2C against the circular rim 4, although it may be desirable that these holding actions could be insured by equipping each of the nipples with, for example, small magnets such as 28 illustrated in FIG. 3.

What is conspicuous is that certain special tools, such as the one shown with the arrangement A of FIGS. 1 and 2, it is appropriate to adjust the length of the rods 15 in such a way that the opening action or gap 26 is adequate for enabling the changing of these tools. It is also imagined to use specific tools for the "fixed member" or the "movable or adjustable member" version. This involves the necessity of having the members provided either with two nipples arranged on the same side or on radius R for the fixed member or else two nipples arranged on the same side on a radius R1 for the movable or shiftable member.

As may be gathered from the above description, the user of the invention will be able to avail himself of a device that enables a quick insertion or removal of cutting members or tools carried by one or several circular arrangements. This will enable the person to carry out such operation of changing the tools in a very limited lapse of time, which achievement insures an improved production speed and yield for the machine.

Although various minor modifications may be suggested by those versed in the art, it should be understood that I wish to embody within the scope of the patent granted hereon all such modifications as reasonably and properly come within the scope of my contribution to the art.

We claim:

1. In a circular tool arrangement which is laterally shiftable along a rotary shaft for mounting tools on said shaft, said arrangement including means for supporting the tools in the arrangement, means for holding the tools against said means for supporting the tools and means for shifting said means for holding, the improvements comprising the means for supporting the tools consisting of a circular first rim having an engagement surface which is provided with a first plurality of circular seats arranged circumferentially on a circle of a constant first radius centered on an axis of the rotary shaft, said first rim having a groove forming a seat for receiving an inner rim which has teeth on a periphery thereof, said inner rim having an engagement surface lying substantially in a plane of the engagement surface of the first rim being provided with a second plurality of circular seats circumferentially spaced on a second radius, said means for holding consisting of a circular ring having an engagement surface facing the engagement surface of the first rim and being provided with two concentric grooves, said ring having at least one rod extending from the engagement surface of the ring and extending through bores in said first rim and terminating in a head, said head entrapping a compression spring between the head and the first rim to urge said ring into clamping engagement on a tool disposed between the ring and the first rim, said means for shifting the means for holding including a member shiftable laterally along said rotary shaft to cause engagement of the head of the arrangement to urge the head against the spring to shift the ring to an open position.

2. In a circular tool arrangement according to claim 1, wherein each of the bores receiving the shaft having the head has a counterbore for receiving the head of the shaft when the shaft is moved against the spring to open the ring.

3. In a circular tool arrangement according to claim 2, wherein each of the tools consists of a cutting member having a shape of a sector of a circular rim, at least one of said sides of said tool being equipped with spaced projections for engaging in one of the first and second pluralities of circular seats on the first rim and the inner rim.

4. In a circular tool arrangement according to claim 2, wherein each of the tools has one set of projections on one side for engagement in the seats of the first radius and has projections on the other side for engagement in the seats of the second radius.

5. In a circular tool arrangement according to claim 1, wherein said member is a pressure ring.

6. In a circular tool arrangement according to claim 1, wherein said member is an adjacent circular tool arrangement on said rotary shaft.

* * * * *